US010433682B2

(12) United States Patent
McNicholas

(10) Patent No.: US 10,433,682 B2
(45) Date of Patent: Oct. 8, 2019

(54) CLAMP-ON PAPER TOWEL HOLDER

(71) Applicant: James McNicholas, Staten Island, NY (US)

(72) Inventor: James McNicholas, Staten Island, NY (US)

( * ) Notice: Subject to any disclaimer, the term of this patent is extended or adjusted under 35 U.S.C. 154(b) by 0 days.

(21) Appl. No.: 15/731,368

(22) Filed: Jun. 3, 2017

(65) Prior Publication Data

US 2017/0273516 A1 Sep. 28, 2017

Related U.S. Application Data

(63) Continuation-in-part of application No. 14/272,499, filed on May 7, 2014, now abandoned.

(51) Int. Cl.
*A47K 10/22* (2006.01)
*A47K 10/32* (2006.01)

(52) U.S. Cl.
CPC ..... *A47K 10/22* (2013.01); *A47K 2010/3233* (2013.01); *A47K 2201/00* (2013.01)

(58) Field of Classification Search
CPC ..... A47K 10/22; A47K 10/24; A47K 10/40; A47K 2201/00; A47K 2010/3233; B65H 35/0006; B65H 49/30; B65H 2403/72; B65H 2701/31
See application file for complete search history.

(56) References Cited

U.S. PATENT DOCUMENTS 906,347 A * 12/1908 Willner ..... B65H 23/08 211/44
1,656,464 A * 1/1928 Auren ..... D04B 3/06 242/136
1,891,629 A * 12/1932 Van Wagner ..... A61G 7/0502 225/84
2,041,384 A * 5/1936 Tueckmantel ..... A01K 97/16 242/404.2
2,339,926 A * 1/1944 Hays ..... G03D 13/145 242/129.51
2,410,328 A * 10/1946 Agamaite, Jr. ..... A47K 10/22 242/422.4
2,561,972 A * 7/1951 Cederberg ..... A47K 10/38 242/422.4
5,240,234 A * 8/1993 Lee ..... E04D 13/0722 248/48.2
5,950,961 A * 9/1999 Duck ..... A47K 10/40 242/423.1

* cited by examiner

*Primary Examiner* — William A. Rivera

(57) ABSTRACT

A clamp-on paper towel holder has a back plate, a first and second holder arm, one or more clamps and a pop-up retainer. The first and second holder arms work together to grasp both ends of a paper towel roll and suspend the roll therebetween. The clamps mount on the back plate at mounting attachment points. Near each attachment point is a clamp extension against which the user can squeeze the clamp handle when desiring to open the clamp and reposition the holder between mounting locations. The clamps can grasp onto poles, rails, table edges, chairs, etc. and firmly suspend the holder therefrom. A user can simply squeeze the clamp's handles to open the clamps, reposition them, and then release the clamp handles to lock the holder in place. The pop-up retainer keeps the towel roll from unraveling in the wind.

20 Claims, 14 Drawing Sheets

10

10

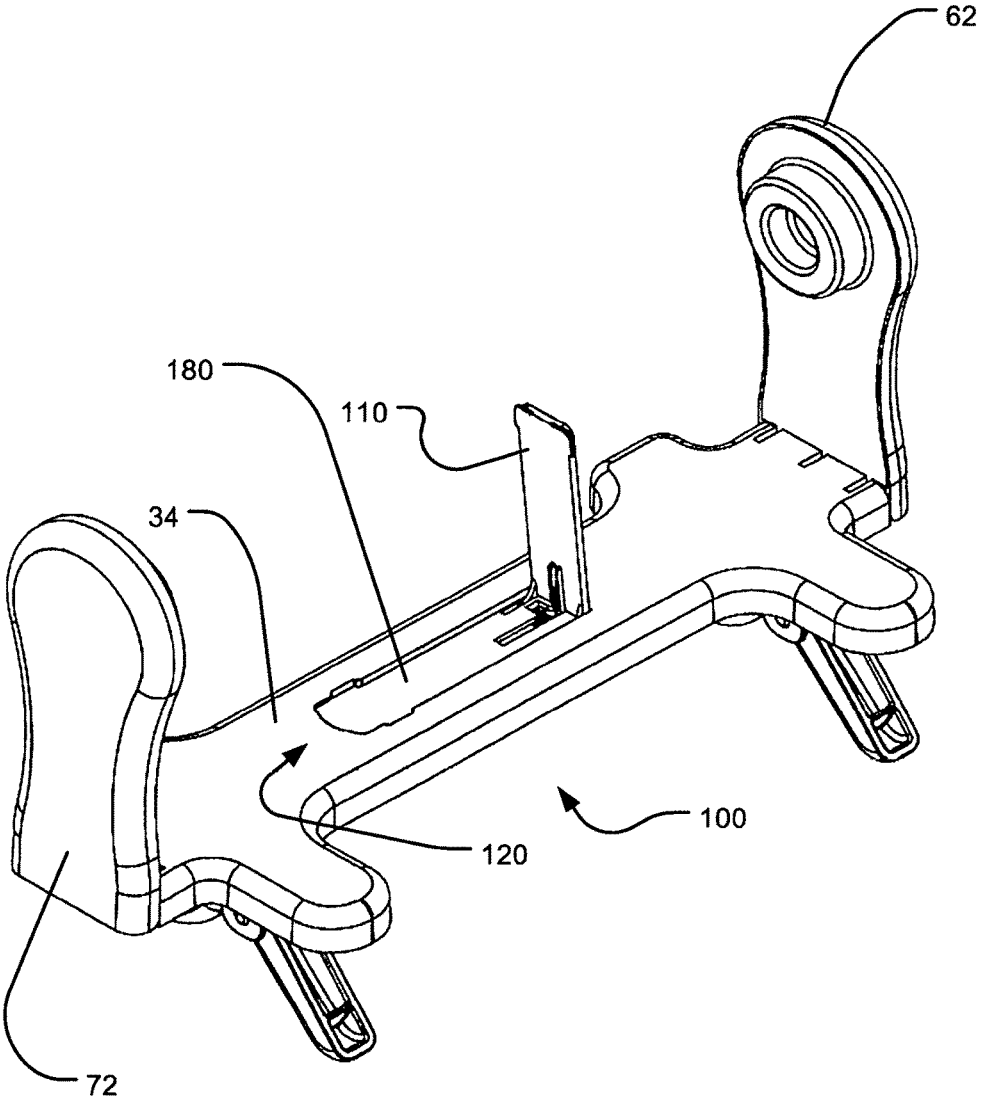
FIG. 9
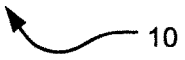

100

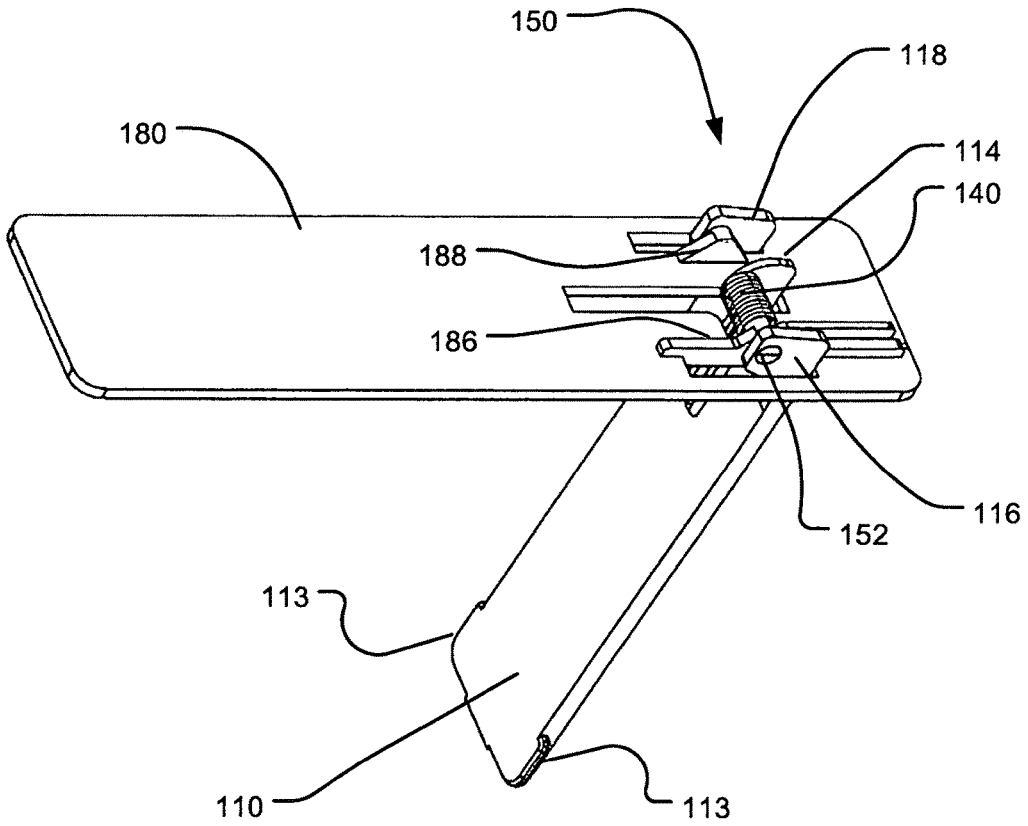
FIG. 13
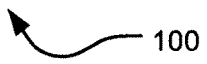

CLAMP-ON PAPER TOWEL HOLDER

CROSS-REFERENCE TO RELATED APPLICATIONS

This application claims the benefit of U.S. application Ser. No. 14/272,499 entitled CLAMP-ON PAPER TOWEL HOLDER and filed on May 7, 2014, which itself claims the benefit of U.S. Provisional Application No. 61/820,690 entitled CLAMP-ON PAPER TOWEL HOLDER and filed on May 7, 2013, both of which are specifically incorporated by reference herein for all that they disclose and teach.

TECHNICAL FIELD

The present invention relates generally to the field of cleaning conveniences; and, more particularly, to a clamp-on paper towel holder.

BACKGROUND

Paper towels are one of the modern world's more ubiquitous cleaning conveniences. They have a myriad of uses from mopping up spills to drying wet hands. Paper towels are available in a multitude of presentations, but perhaps the most commonly found in a residential setting is the paper towel roll. Such rolls are often found free-standing beside sinks, work-benches, grills, picnic tables, outdoor furniture, and shop areas. Although it is quite handy to have a roll of paper towels readily at hand in such locations, if a roll is knocked over, blown down, or otherwise accidentally displaced, the entire roll can become soiled and/or wasted.

In order to address this problem, the prior art is rife with various types of paper towel holders. Most such holders come in two flavors: weighted, free-standing models and permanently affixed devices. The latter are often found in the form of paper towel rods or holders that are permanently affixed near sinks, work benches, and other indoor locations; while the former, free-standing models, are moved about as needed. The permanently affixed devices are limiting in that they can not be easily removed when not in use and they can be an encumbrance to the unencumbered use of the surrounding area. The weighted, free-standing models, although usually better than no holder at all, can still be knocked/blown over resulting in the waste of much, if not all, of the roll. Furthermore, such models often require the use of two hands to cleanly remove a single paper towel without unraveling a number of towels from the roll. Additionally, the free-standing models require the use of limited counter- or table-space.

What is needed is a removable, yet solidly affixable, paper towel holder that can be easily transported between work areas, assists users in providing single paper towels as needed, and utilizes a pop-up retainer to retain paper towels on the roll when a person is not intentionally dispensing them.

SUMMARY

A clamp-on paper towel holder includes: a back plate, a first holder arm, a second holder arm, a plurality of clamps, and a pop-up retainer. The plurality of clamps is mounted on the back plate at a plurality of mounting attachment points. The clamps are adapted to grasp onto poles, rails, table edges, chairs, etc. and firmly suspend the holder therefrom. A user can simply squeeze the clamp's handles to open the clamps, reposition them as desired, and then release the clamp handles to lock the holder in place. The clamp-on paper towel holder is then suspended from a new location and ready to dispense paper towels as needed. The back plate extends between the first holder arm and the second holder arm and provides rigidity and support to the arms such that they can adequately grasp and hold a roll of paper towels. The pop-up retainer can be fully enclosed within the back plate when not needed, and is then easily popped-up when desired. It puts tension against the paper towel roll and keeps the towels from unwinding and/or dispensing when such is not desired due to wind, etc.

The plurality of clamps is attached to the back plate at a plurality of mounting attachment points. In proximity to each attachment point is a clamp extension against which the user can squeeze the clamp handle when he or she wishes to open the clamp and reposition the holder or otherwise remove it from a pole or other mounting location. Each attachment point can further comprise a set of vertical hinge points extending outwards from the back plate and receiving therebetween the hinge of the clamp on a hinge pin or similar structure. Each clamp has a spring apparatus that provides the clamping force thereof.

BRIEF DESCRIPTION OF THE DRAWINGS

FIG. 9 illustrates a perspective view of an exemplary embodiment of a clamp-on paper towel holder with a pop-up retainer in an upright position;

FIG. 13 illustrates a close-up perspective view of the underside of an exemplary embodiment of the slide plate of a pop-up retainer highlighting the hinge components.

DETAILED DESCRIPTION

Figure 1:
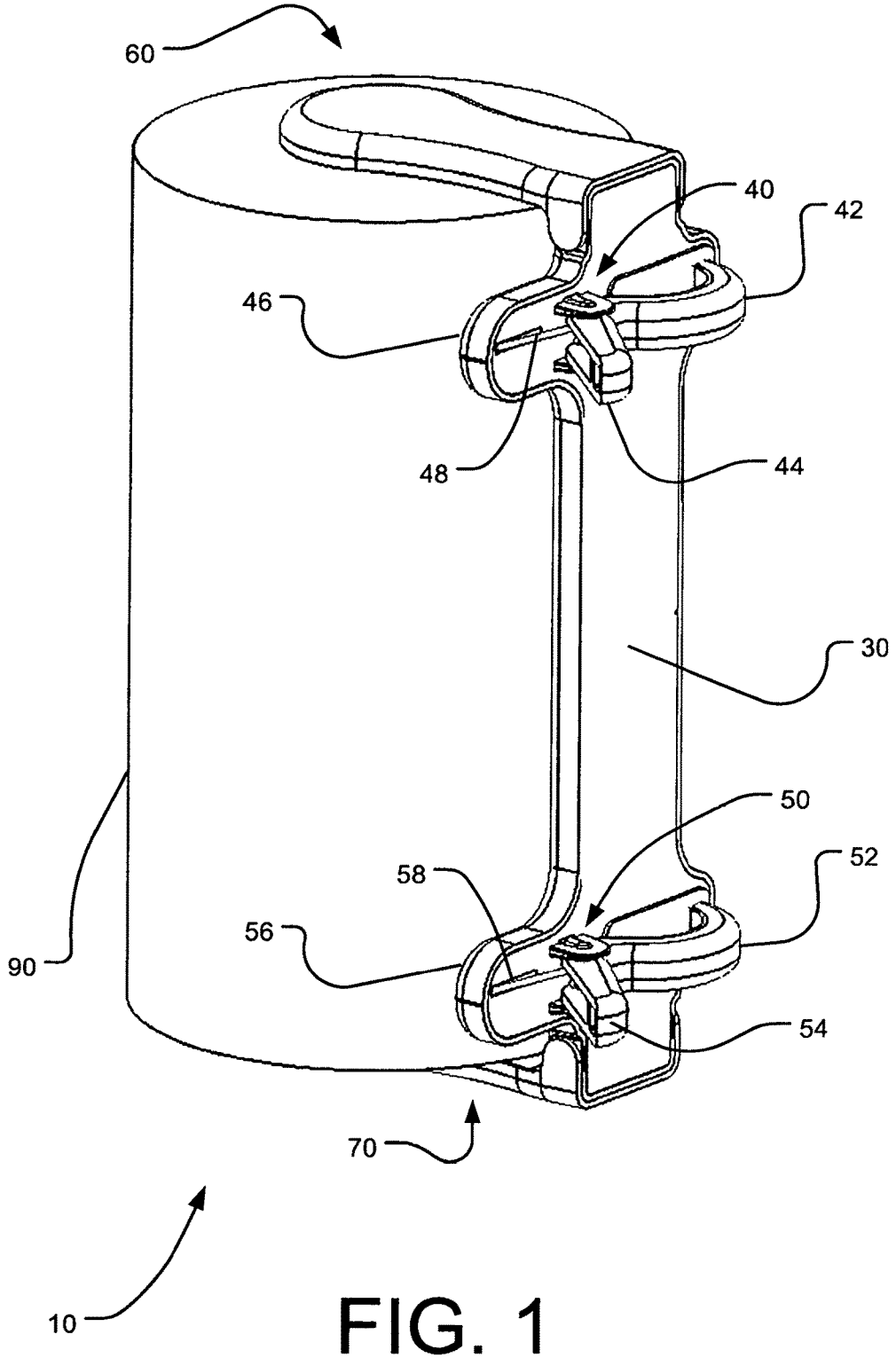
FIG. 1 illustrates a perspective view of an exemplary embodiment of a clamp-on paper towel holder in a vertical orientation with a roll of paper towels held therein.

In the following discussion, numerous specific details are set forth to provide a thorough understanding of the present disclosure. However, those skilled in the art will appreciate that embodiments may be practiced without such specific details. Furthermore, lists and/or examples are often provided and should be interpreted as exemplary only and in no way limiting embodiments to only those examples.

Exemplary embodiments are described below in the accompanying Figures. The following detailed description provides a comprehensive review of the drawing Figures in order to provide a thorough understanding of, and an enabling description for, these embodiments. One having ordinary skill in the art will understand that in some cases well-known structures and functions have not been shown or described in detail to avoid unnecessarily obscuring the description of the embodiments.

Referring now to the drawings, FIG. 1 illustrates a perspective view of an exemplary embodiment of a clamp-on paper towel holder in a vertical orientation with a roll of paper towels held therein. The embodiment of the clamp-on paper towel holder 10 illustrated in FIG. 1 includes: a back plate 30, a first holder arm 60, a second holder arm 70, and a plurality of clamps 42 and 52. The plurality of clamps 42 and 52 are mounted on the back plate 30 at a plurality of mounting attachment points 40 and 50. The plurality of clamps 42 and 52 can number one, two, three or more. The plurality of clamps 42 and 52 are adapted to grasp onto poles, rails, table edges, chairs, etc. and firmly suspend the holder 10 therefrom. A user can simply squeeze the clamp handles 44 and 54 to open the clamps 42 and 52, reposition them as desired and release the clamp handles 44 and 54. The clamp-on paper towel holder is then suspended from a new location and ready to dispense paper towels as needed.

The back plate 30 extends between the first holder arm 60 and the second holder arm 70 and provides rigidity and support to the arms such that they can adequately grasp and hold a roll of paper towels 90. The holder arms 60 and 70 are illustrated in FIG. 1 as being rigidly affixed to the back plate 30. However, in other embodiments, one or more of the holder arms 60 and 70 can be hingedly attached to the back plate 30 such that the arms can swing towards the front plate 34 (not illustrated in FIG. 1, see FIG. 5) when not in use. Furthermore, an embodiment having a non-rigidly attached holder arm arrangement can include a certain amount of flex, one or more springs, etc. in the arm(s) so that the arms squeeze the paper towel roll 90 to provide a better hold thereon and also allow easier removal of a single towel without the roll unspooling. In yet other embodiment, a non-unspooling gripper or similar device can be added to the holder 10 to further retard unwanted unspooling.

The plurality of clamps 42 and 52 are attached to the back plate 30 at a plurality of mounting attachment points 40 and 50. In proximity to each attachment point 40 and 50 is a clamp extension 46 and 56 against which the user can squeeze the clamp handle 44 and 54 when he or she wishes to open the clamp 42 and 52 and reposition the holder 10 or otherwise remove it from a pole or other mounting location. Each attachment point 40 and 50 can further comprise a set of vertical hinge points extending outwards from the back plate 30 and receiving therebetween the hinge of the clamp 42 and 52. Each clamp 42 and 52 has a spring apparatus 48 and 58 that provides the clamping force thereof. Various types of spring apparatuses may be used in other embodiments.

Figure 2:
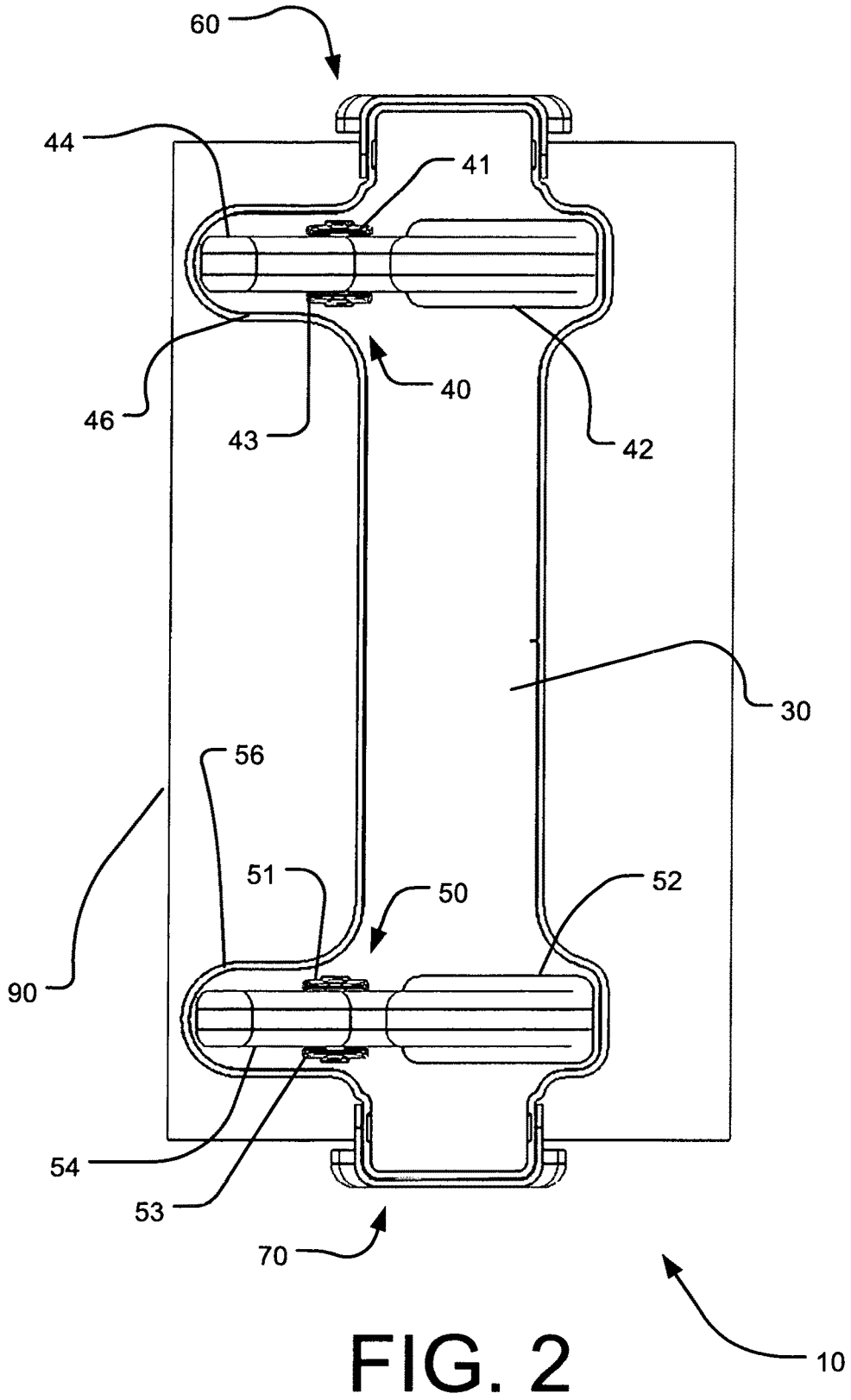
FIG. 2 illustrates a perspective front view of an exemplary embodiment of a clamp-on paper towel holder.

FIG. 2 illustrates a perspective front view of an exemplary embodiment of a clamp-on paper towel holder 10. The back plate 30 and plurality of clamps 42 and 52 can be more clearly seen in this view. Note that the embodiment in FIG. 2 is illustrated with the clamp attachment points 40 and 50 offset to one side of the centerline of the back plate 30. In other embodiments, the attachment points 40 and 50 are located on the centerline, or across onto the other side of the centerline.

Each clamp 42 and 52 attaches to the back plate 30 at a mounting attachment point 40 and 50. The attachment points 40 and 50 each comprise a set of hinge points (hinge points 41 and 43 for attachment point 40 and hinge points 51 and 53 for attachment point 40). Each set of hinge points 41 & 43 and 51 & 53 extends generally perpendicular from the surface of the back plate 30 and provides a location on which the associated clamp 42 and 52 can hinge.

Figure 3:
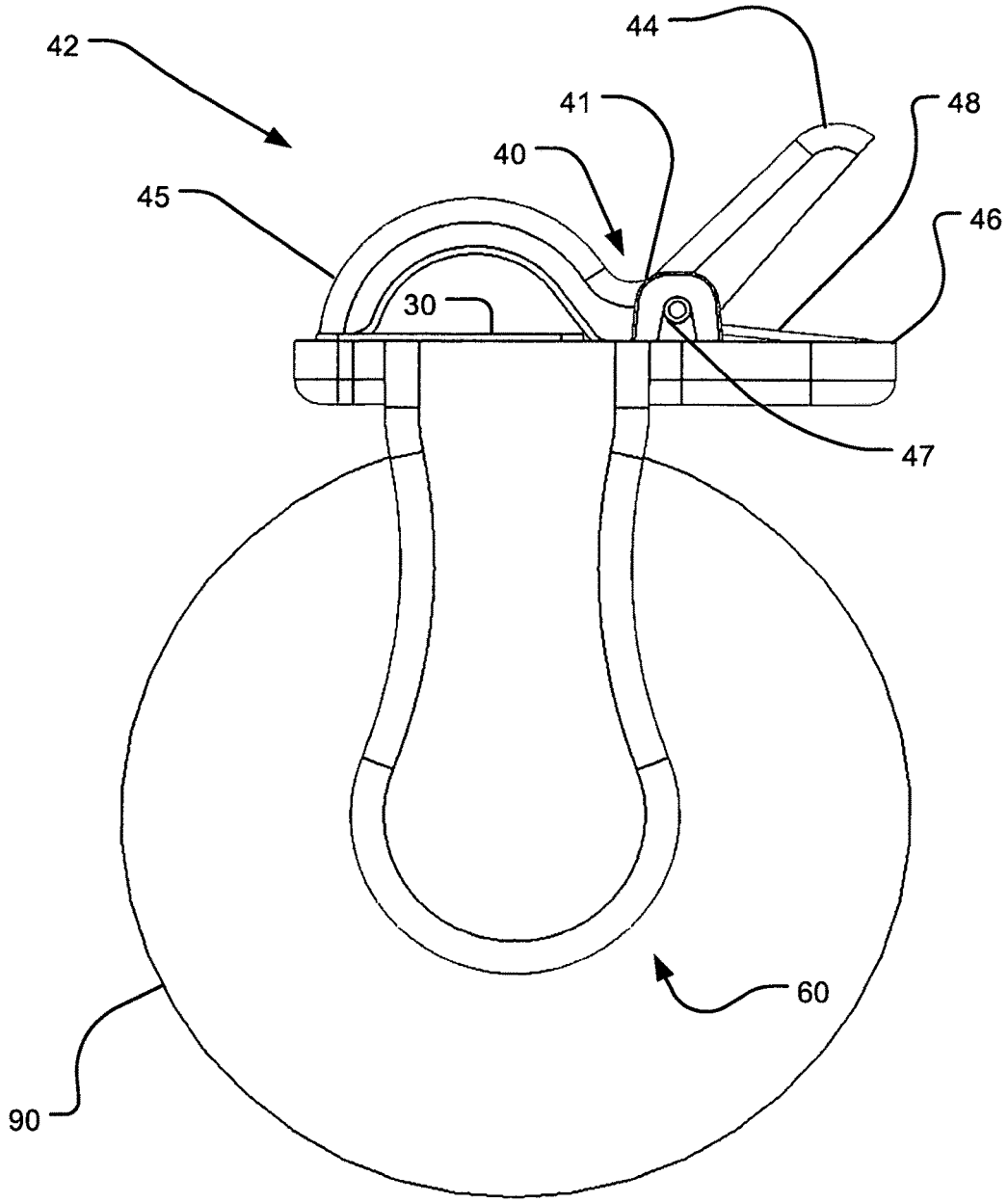
FIG. 3 illustrates a top plan view of an exemplary embodiment of a clamp-on paper towel holder.

FIG. 3 illustrates a top plan view of an exemplary embodiment of a clamp-on paper towel holder 10. Only a single clamp 42 is visible in the view illustrated in FIG. 3, in other embodiments, the number of clamps 42 and 52 can be one, two, three, or more.

The clamp 42 illustrated in FIG. 3 comprises three main components: a clamp handle 44, a clamp jaw 45, and a clamp pin 47 upon which the clamp jaw 45 hinges up and down. When a user squeezes the clamp handle 44 downwards towards the clamp extension 46, the clamp jaw 45 hinges upwards away from the surface of the back plate 30, opening the jaw 45 to allow the insertion of a pole or other object to which the holder 10 is to be mounted. Similarly, to remove the holder 10, a user opens the clamp jaw 45 by squeezing the clamp handle 44. The clamp spring apparatus 48 puts upwards pressure on the clamp handle 44, and thus, downwards pressure on the clamp jaw 45 because of the clamp pin 47 and hinge. This pressure is sufficient to grasp and hold mounting poles or other mounting objects firmly within the clamp jaw 45. Although not illustrated in the embodiment shown in FIG. 3, the clamp jaw 45 can incorporate non-slip grip strips 87 on the jaw and opposing area of the back plate 30, to assist the clamp jaw 45 in firmly holding the pole/mounting object; see the plurality of non-slip grip strips 87 in FIG. 4. Although only one clamp 42 is discussed above, the descriptions are applicably to any of a plurality of clamps 42 and 52.

Figure 4:
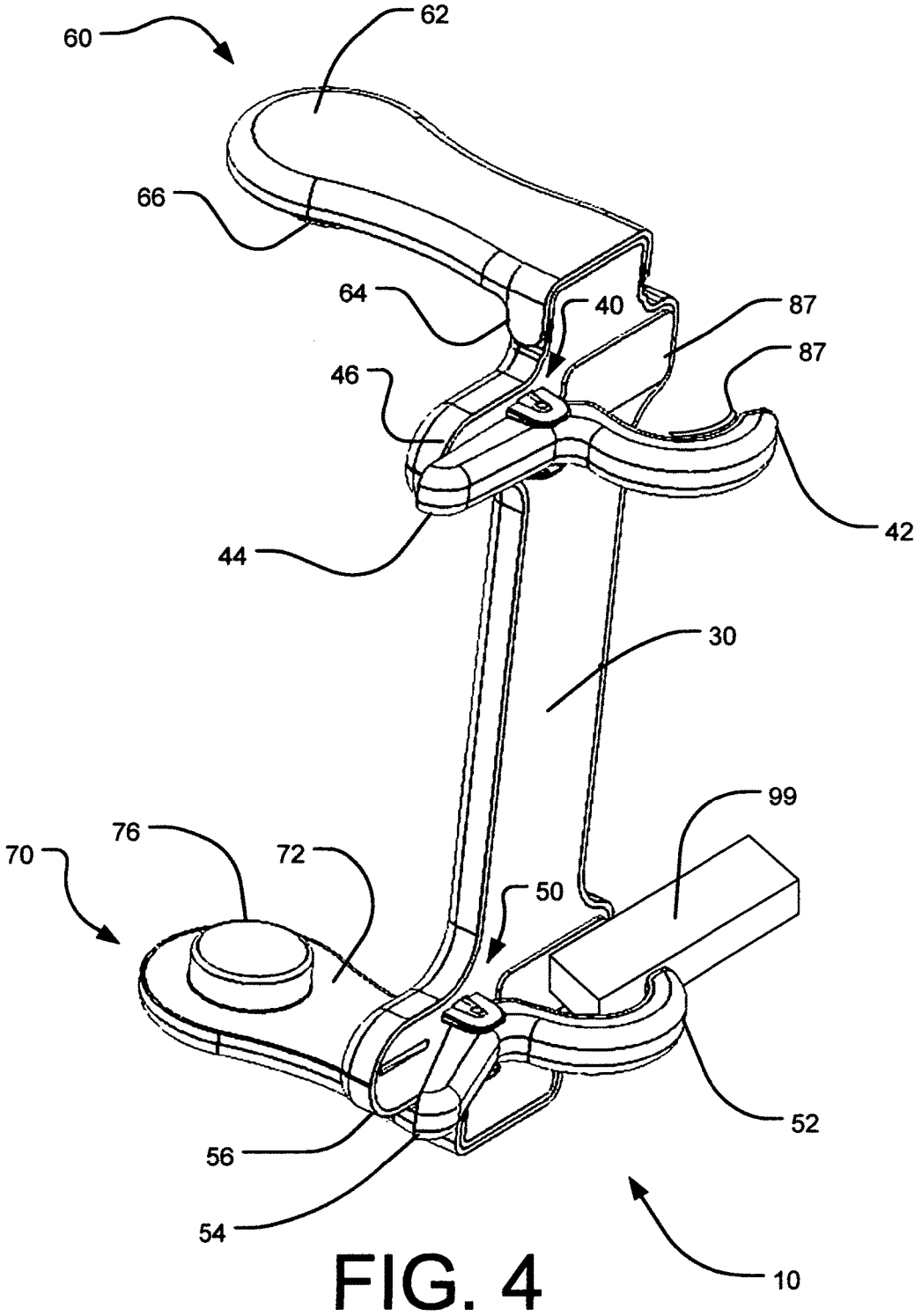
FIG. 4 illustrates a perspective left side view of an exemplary embodiment of a clamp-on paper towel holder with the roll removed.

FIG. 4 illustrates a perspective left side view of an exemplary embodiment of a clamp-on paper towel holder 10 with the roll removed and the plurality of clamps 42 and 52 in a partially open configuration, ready to receive a pole, rail, table edge, etc. therein. The design of the holder 10 is such that round, triangular, rectangular, square, pentangular, hexangular, octangular, oval, and other shapes of poles, rails, counter overhangs, table edges, etc. can be grasped and firmly held by the clamps 42 and 52.

Visible in the illustration of FIG. 4 are the components of the first and second holder arms 60 and 70. These include the first and second extension members 62 and 72, and attached thereto, the first and second core grips 66 and 76. The extension members 62 and 72 allow the arms 60 and 70 to hold rolls of various diameters up to and including oversize rolls. The core grips can be generally cylindrical and extend towards one another, approximately perpendicularly from the first and second holder arms 60 and 70. The core grips 66 and 76 are designed to fit inside the core tube of a roll of paper towels and assist in securing the roll firmly within the holder 10 while still allowing the core tube to turn and dispense paper towels.

A sample mounting object 99 is illustrated as being clamped in a clamp 52.

Figure 5:
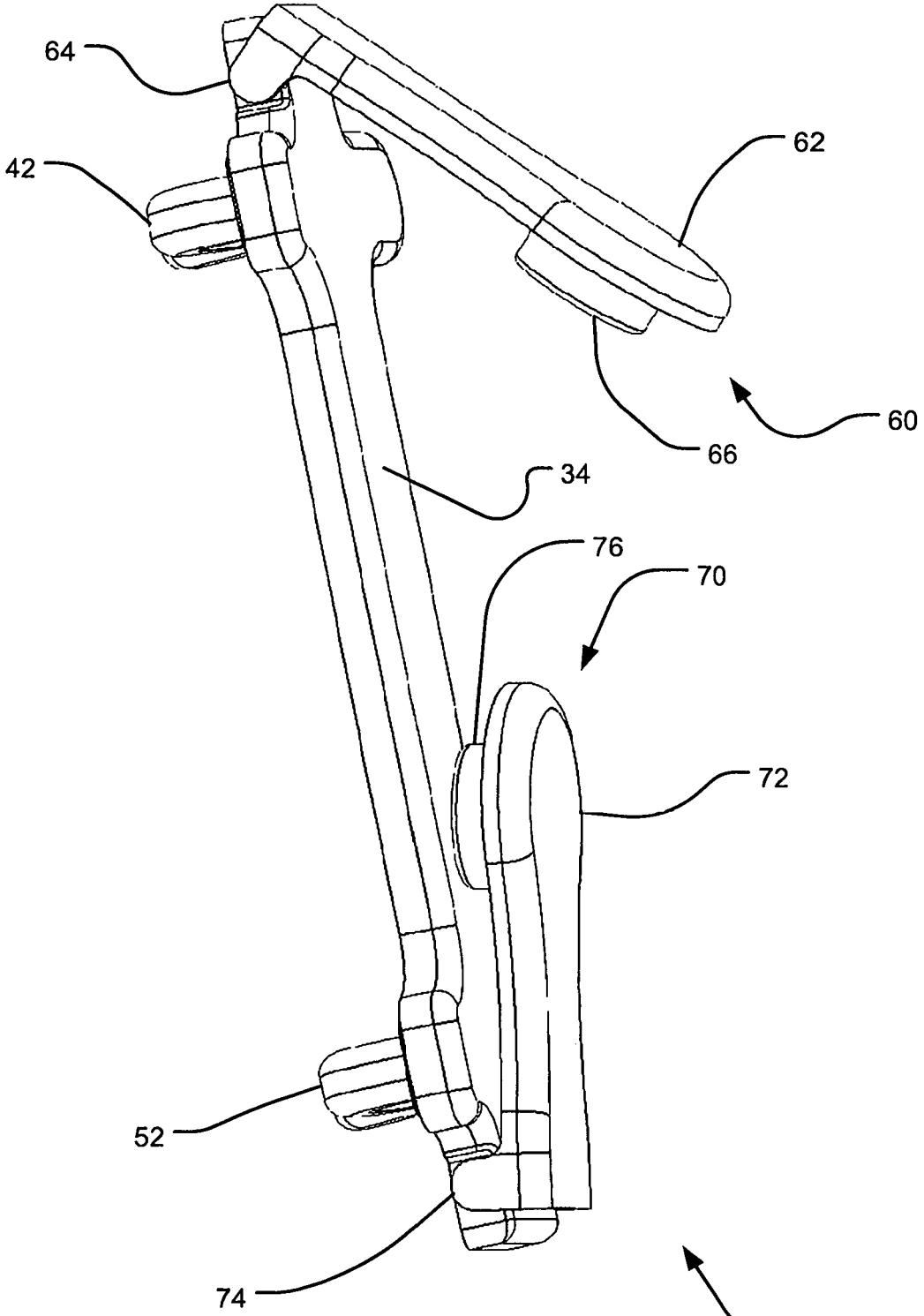
FIG. 5 illustrates a perspective rear view of an exemplary embodiment of a clamp-on paper towel holder illustrating first and second holder arms in folded positions.

FIG. 5 illustrates a perspective rear view of an exemplary embodiment of a clamp-on paper towel holder illustrating first and second holder arms 60 and 70 in folded positions. For example, the first holder arm 60 is shown folded approximately half-way inwards towards the front plate 34 of the holder 10. The holder arms 60 and 70 hinge inwards because of the hingable mounts 64 and 74 as shown in the embodiment of FIG. 5. These mounts rotate relative to the front plate 34, allowing the arms 60 and 70 to hinge. In other embodiments, the arms are rigidly affixed.

Although the second holder arm 70 is illustrated mostly folded, it should be apparent that the second core grip 76 protruding from the second holder arm 70 is keeping the arm 70 from folding completely flat. In another embodiment, a cylindrical matching cutout can be made in the front plate 34 within which the core grip 76 nests, thereby allowing the holder arm 70 to fold completely flush against the front plate 34. Obviously, such an accommodation could also be made for the first core grip 66 and first holder arm 60.

It is important to note that the holder 10 can be mounted on poles/objects that are oriented horizontally as well as vertically. Furthermore, the holder 10 can mount on poles/objects that extend at any angle as the design does not require that a mounting pole/object run horizontally or vertically.

Figure 6:
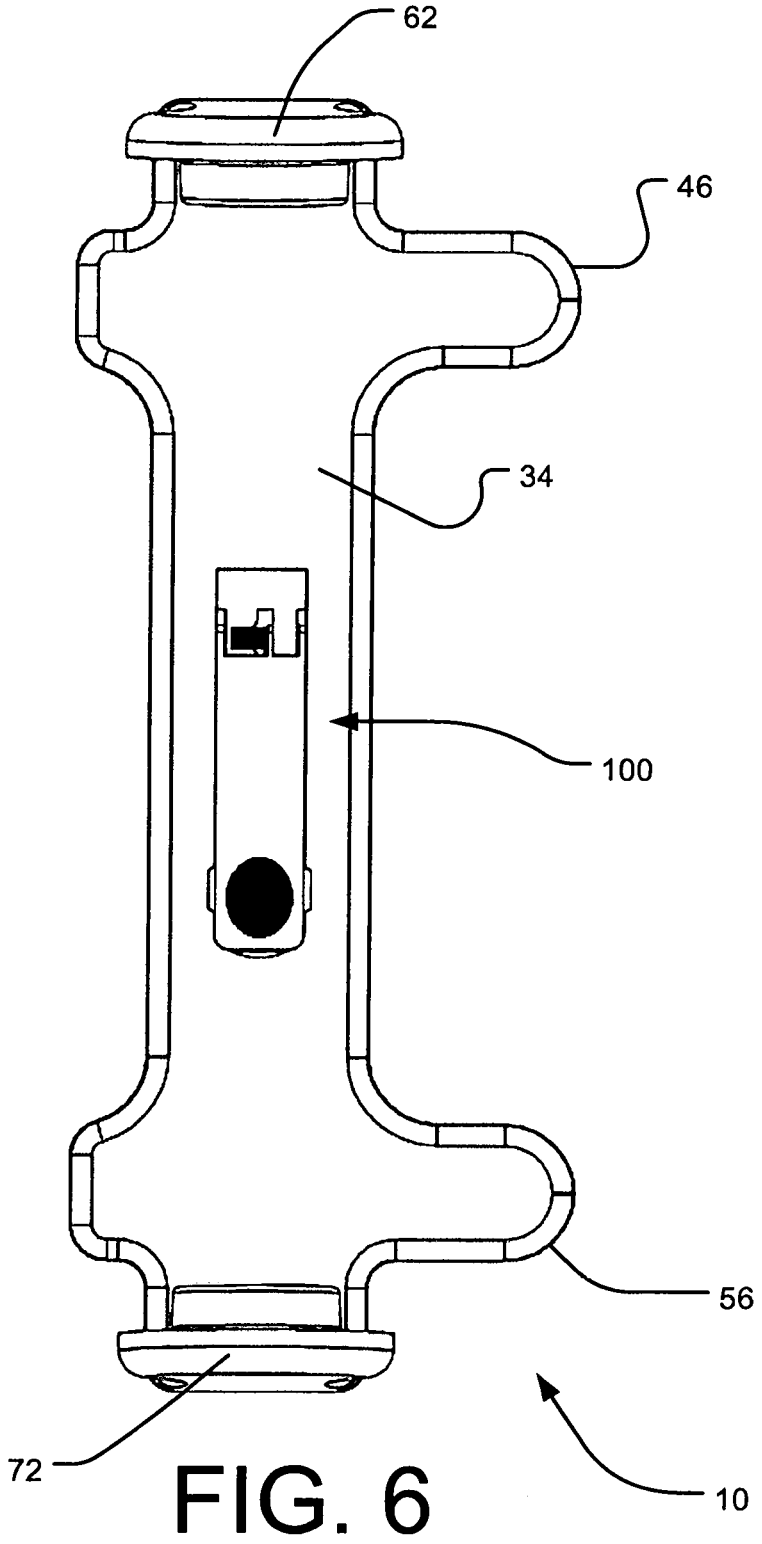
FIG. 6 illustrates a rear elevation view of an exemplary embodiment of a clamp-on paper towel holder without a roll of paper towels so that a pop-up retainer can be highlighted.

FIG. 6 illustrates a rear elevation view of an exemplary embodiment of a clamp-on paper towel holder 10 without a roll of paper towels so that a pop-up retainer 100 can be highlighted. The pop-up retainer 100 can be mounted within the front plate 34 so that when in the stored position (as shown in FIG. 6) no portion of the retainer 100 extends beyond the top surface of the front plate 34. This allows a large roll of paper towels to be mounted in the holder 10 without being restricted in its dispensing and/or rotations by impacting any portion of the stored pop-up retainer 100.

Figure 7:
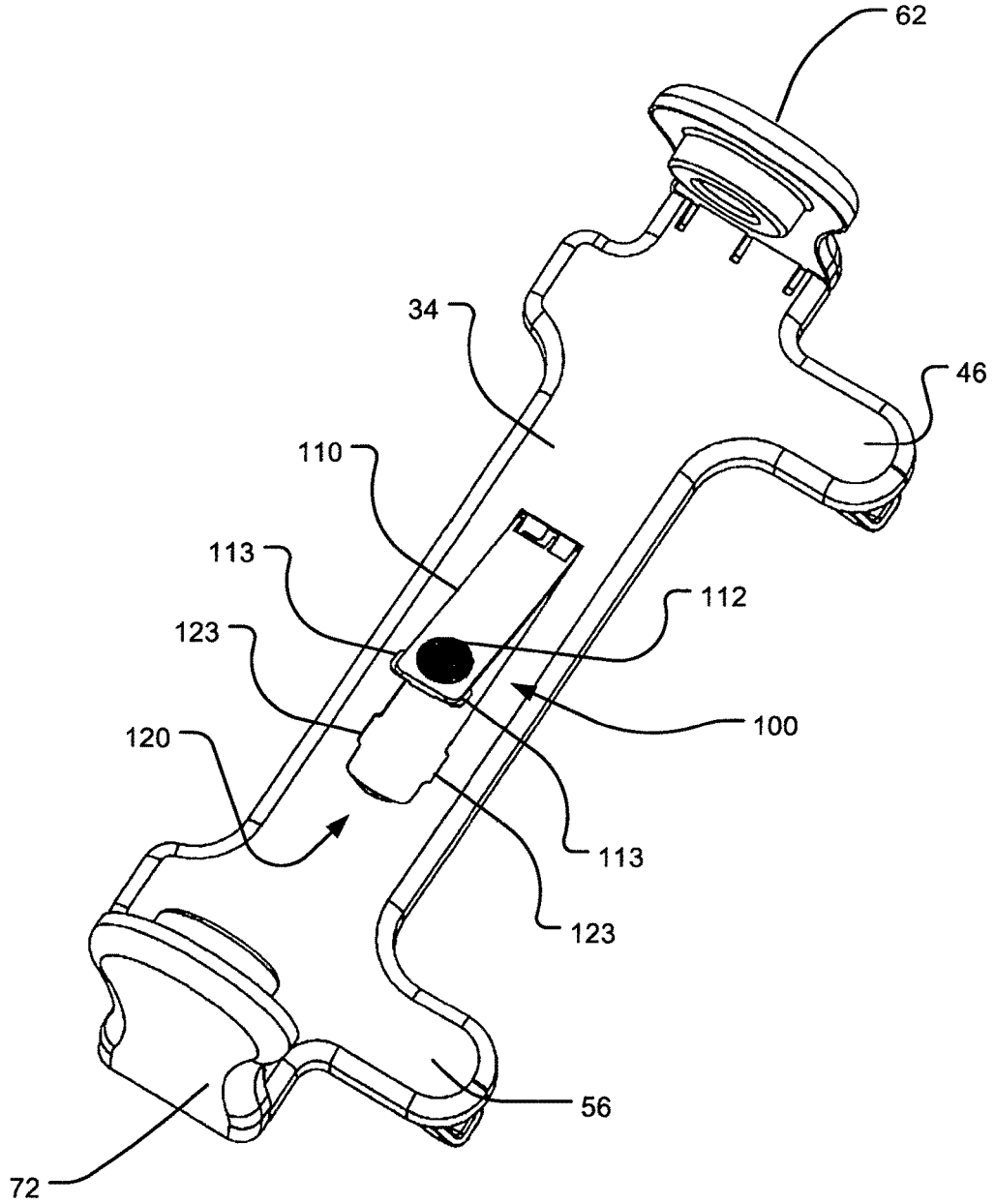
FIG. 7 illustrates a rear perspective view of an exemplary embodiment of a clamp-on paper towel holder highlighting a pop-up retainer in a partially popped-up position.

FIG. 7 illustrates a rear perspective view of an exemplary embodiment of a clamp-on paper towel holder 10 highlighting a pop-up retainer 100 in a partially popped-up position. This is the proper deployed position for contacting a roll of paper towels. However, no towels are shown in this illustration (see FIG. 8). The pop-up retainer 100 has a retention paddle 110 which springs upwards from the front plate 34 and impacts the roll of paper towels in order to hold the roll in place so that it can not spin in the wind or otherwise inadvertently release paper towels. Yet, a user can simply pull on the first paper towel sheet and unwind the roll, tear off a paper towel, and leave the clamp-on paper towel holder in position and ready to dispense the next paper towel, all without interacting directly with the pop-up retainer 100.

In order to initially deploy the pop-up retainer 100 from the front plate 34, a user simply pushes on the deployment button 112 and slides the pop-up retainer 100 horizontally towards the first extension member 62. This disengages a plurality of paddle lock tabs 113 from the storage slot 120 by moving the paddle lock tabs 113 beyond the overhang and into a plurality of cutouts 123 which then allow the paddle lock tabs 113 to clear the front plate 34; thereby allowing the retention paddle 110 to pop-up and into position.

Figure 8:
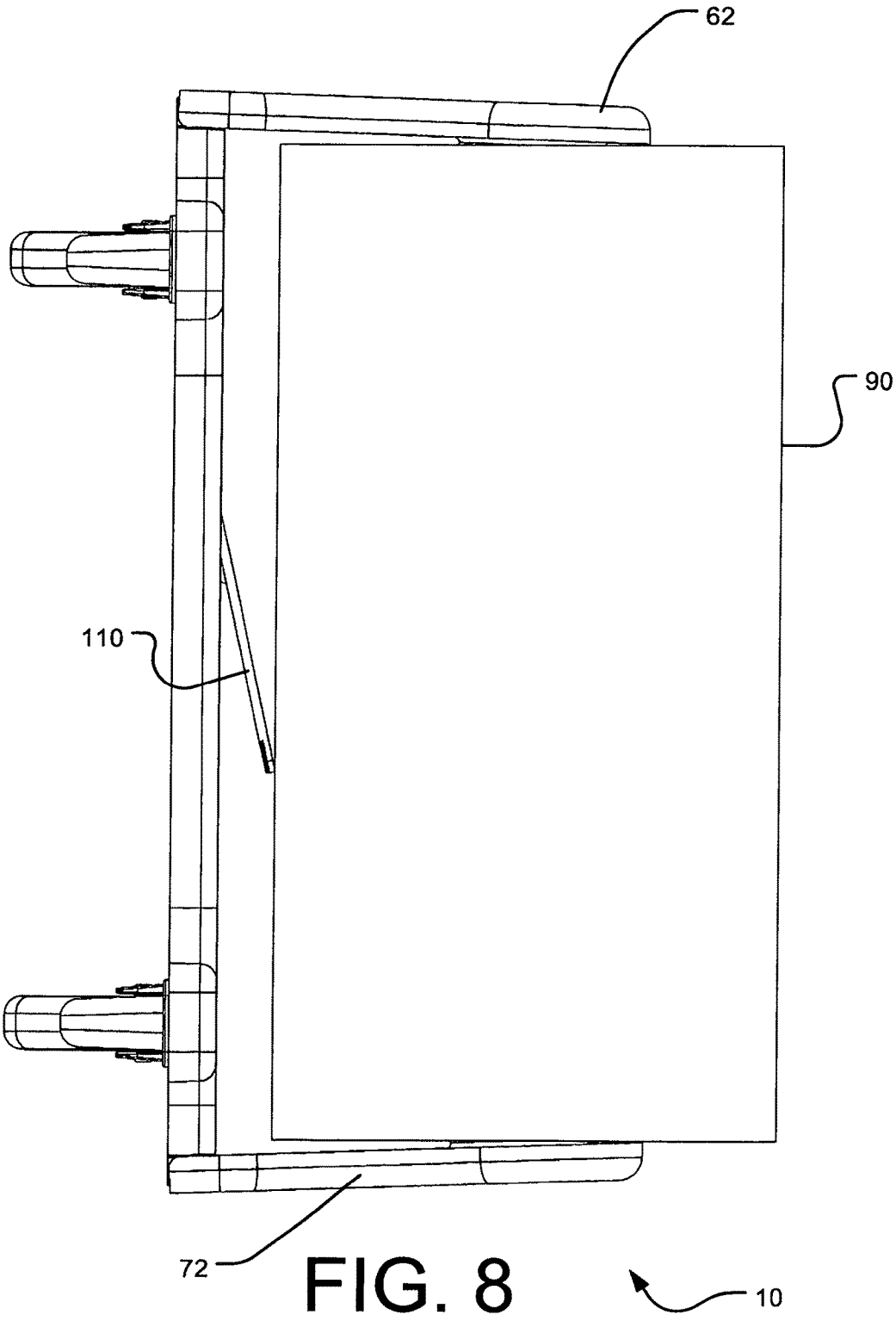
FIG. 8 illustrates a side elevation view of an exemplary embodiment of a clamp-on paper towel holder with a roll of paper towels in place and a retention paddle in a retaining position against the roll of paper towels.

FIG. 8 illustrates a side elevation view of an exemplary embodiment of a clamp-on paper towel holder 10 with a roll of paper towels 90 in place and a retention paddle 110 in a retaining position against the roll of paper towels 90. Note that the pop-up retainer in FIG. 8 has been actuated so that the retention paddle 110 is popped-up and pressing against the roll of paper towels thereby effectively holding the paper towel roll in place and helping to keep it from spinning due to wind or some other unwanted actuator. However, if a user unrolls the paper towel roll, the retention paddle 110 simply allows the roll to slide past it and controllably dispense one or more paper towels as desired by the user.

FIG. 9 illustrates a perspective view of an exemplary embodiment of a clamp-on paper towel holder 10 with a pop-up retainer 100 in an upright position. If no roll of paper towels is present and the retainer 100 is deployed, it will pop-up fully into a position similar to that shown in FIG. 9. In other embodiments, the paddle 110 can stand more or less vertical than that shown in FIG. 9.

Figure 10:
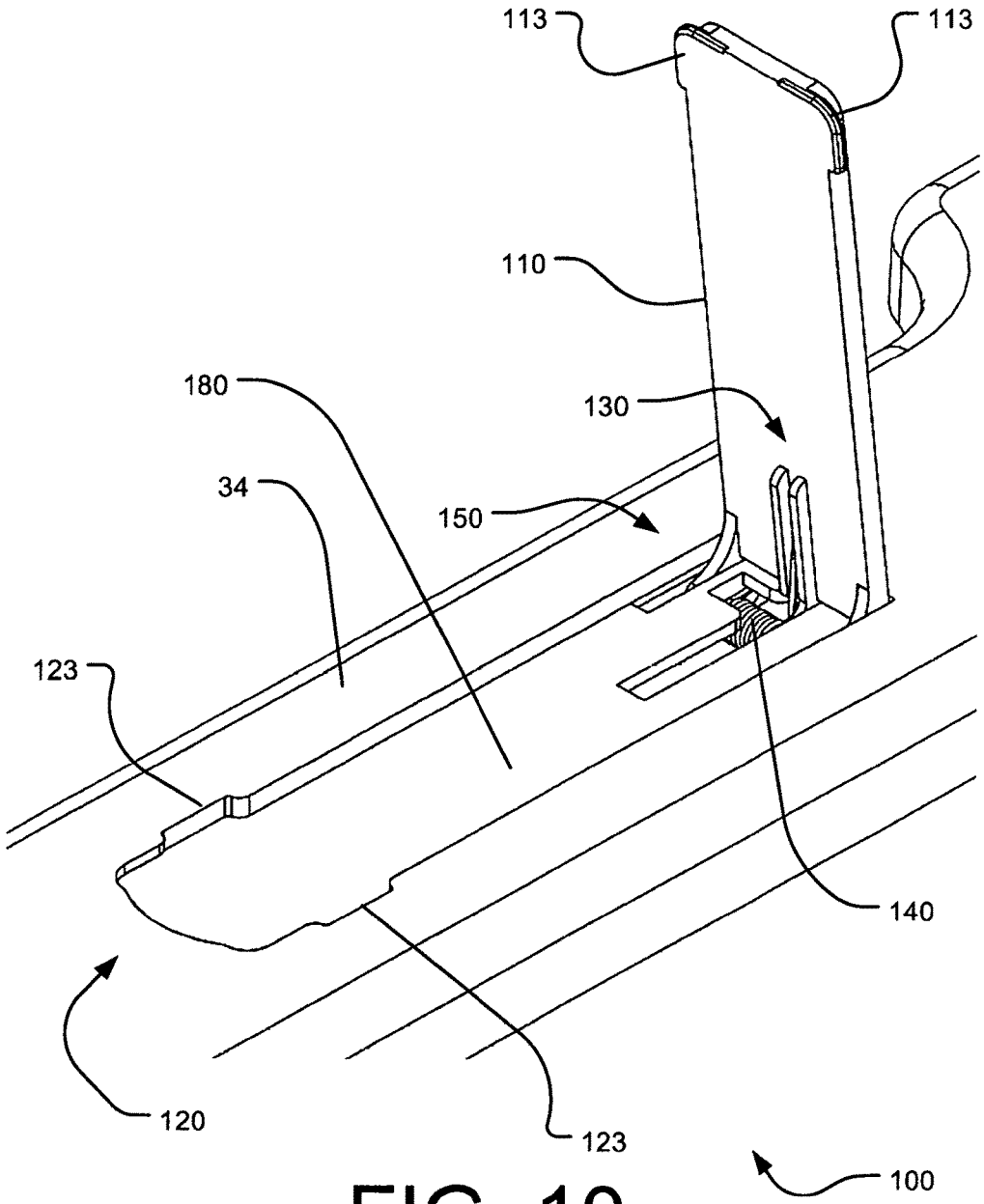
FIG. 10 illustrates a close-up perspective view of an exemplary embodiment of a pop-up retainer in an upright position.

FIG. 10 illustrates a close-up perspective view of an exemplary embodiment of a pop-up retainer 100 in an upright position. Here, the retention paddle 110 is mostly upright as no roll of paper towels is present. The paddle lock tabs 113 are illustrated and the corresponding cutouts 123 can be clearly seen in the front plate 34 to make the shape of the storage slot 120 match that of the retention paddle 110.

Below the front plate 34 is a slide plate 180 which retains the pop-up retainer 100 in place within the front plate 34 even when the retention paddle 110 is deployed. The slide plate is hingeably attached via hinge 150 to the retention paddle 110 and the two have a spring 140 that is under tension to automatically deploy the retention paddle 110 upwards when the pop-up retainer is slid so that the paddle lock tabs 113 can clear the cutouts 123. The spring 140 can be held in place against the retention paddle 110 via the plurality of spring guides 130.

Figure 11:
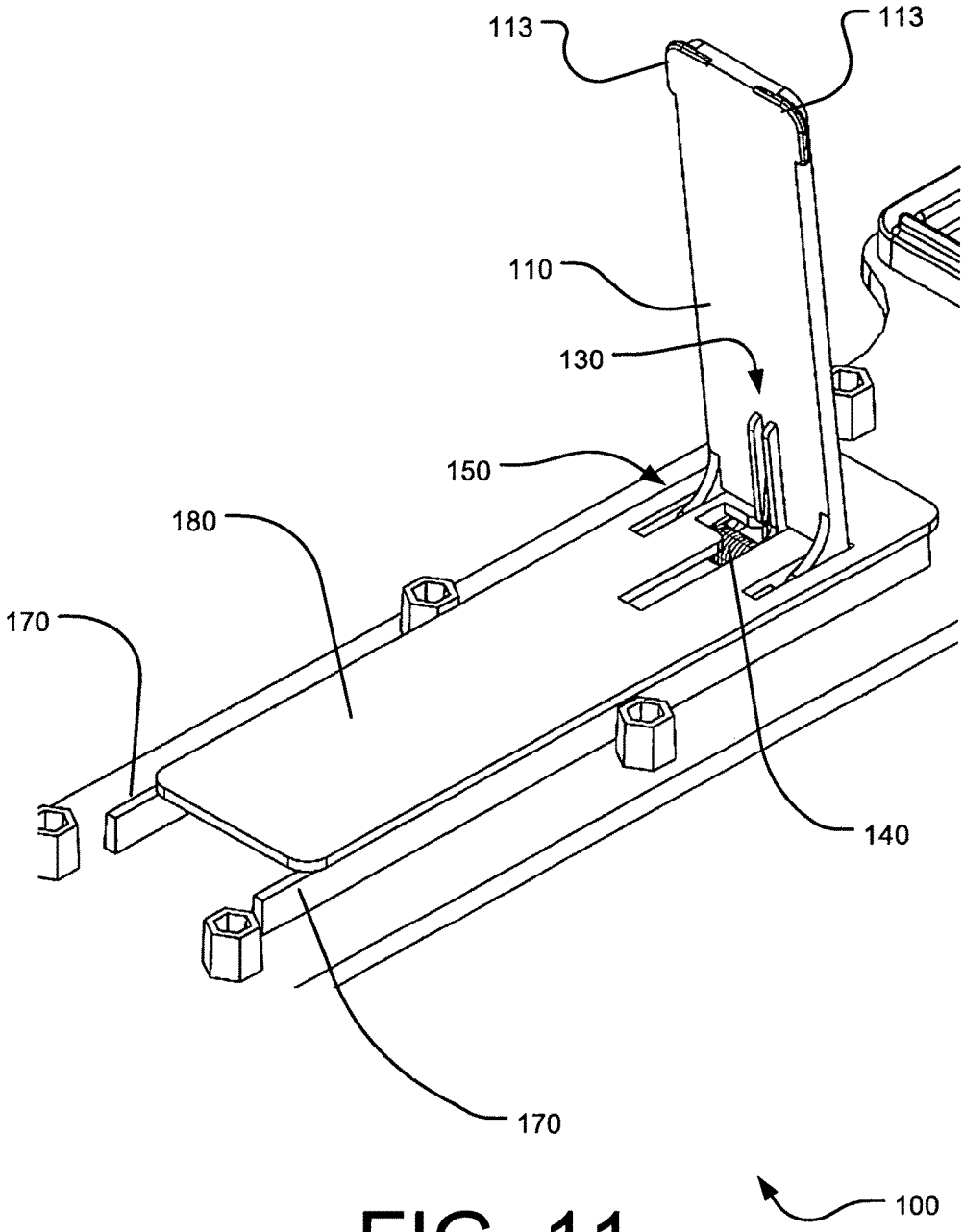
FIG. 11 illustrates a close-up perspective view of an exemplary embodiment of a pop-up retainer in an upright position with the front plate of the clamp-on paper towel holder removed.

FIG. 11 illustrates a close-up perspective view of an exemplary embodiment of a pop-up retainer 100 in an upright position with the front plate 34 of the clamp-on paper towel holder 10 removed. Thus, the slide plate 180 can be clearly seen riding on a plurality of slide rails 170. The pop-up retainer 100 can slide forwards on the slide rails 170 to lock the paddle lock tabs 113 in place under the overhang of the front plate 34 when the pop-up retainer 100 is stored and can be slid backwards along the slide rails 170 so that the paddle lock tabs 113 can clear the cutouts 123 (see earlier FIGs.) when the user decides to deploy the pop-up retainer 100.

Figure 12:
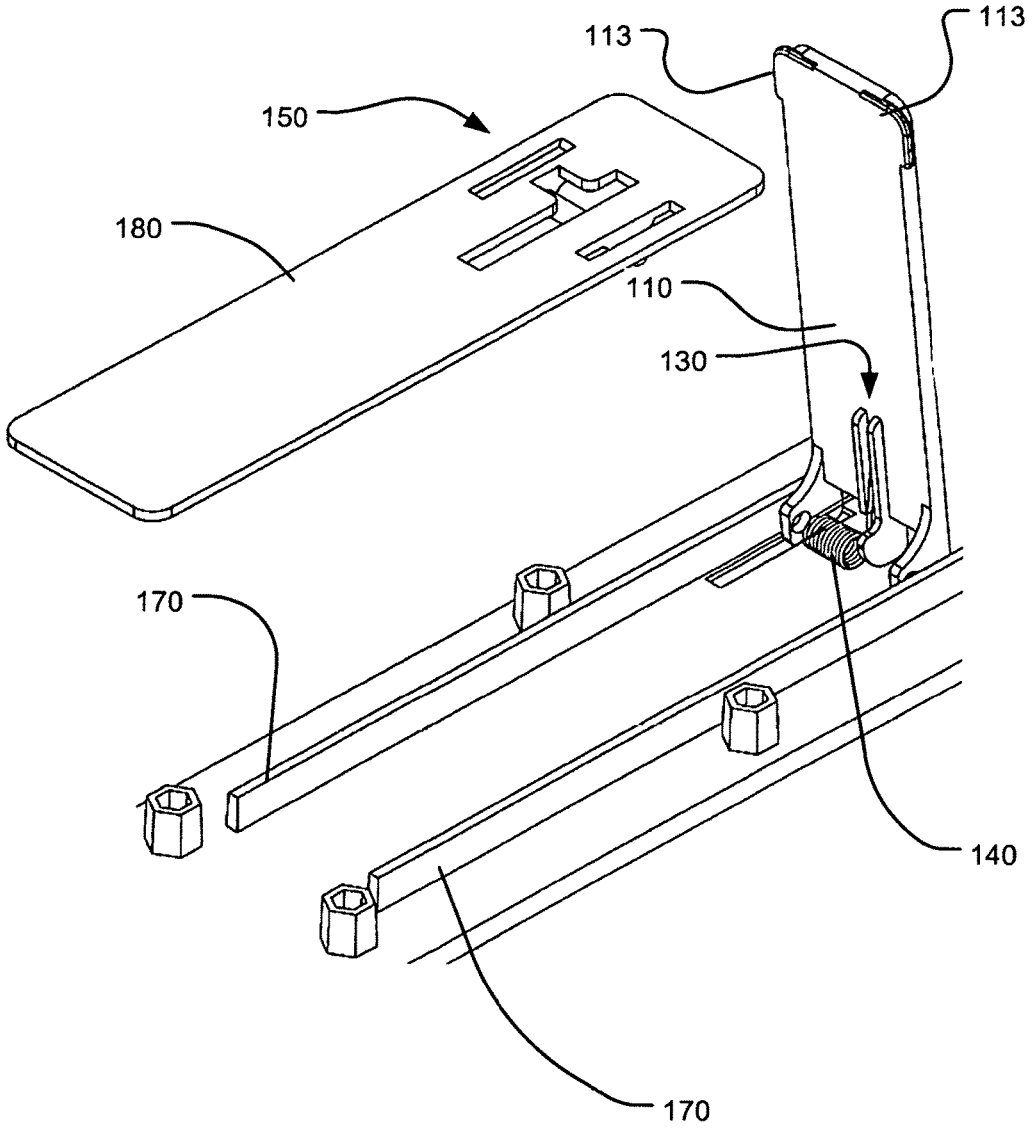
FIG. 12 illustrates a close-up perspective view of an exemplary embodiment of a pop-up retainer with the slide plate exploded out.

FIG. 12 illustrates a close-up perspective view of an exemplary embodiment of a pop-up retainer 100 with the slide plate 180 exploded out from the retention paddle 110 so that the spring and related hinge 150 components can be seen. In other embodiments, other ways of hinging the retention paddle 110 so that it can be stored and deployed are contemplated.

FIG. 13 illustrates a close-up perspective view of the underside of an exemplary embodiment of the slide plate 180 of a pop-up retainer 100 highlighting the hinge components 150. In this embodiment, the retention paddle 110 utilizes a plurality of hinge protrusions 114, 116, and 118 that extend through corresponding hinge ports on the slide plate 180 thereby allowing the retention paddle 110 and slide plate 180 to enmesh with each other in an easily hinged configuration. In other embodiments, other mechanisms are contemplated.

In the embodiment illustrated in FIG. 13, the slide plate utilizes a plurality of slide plate hinge protrusions 186 and 188 in order to work in tandem with other hinge components 150 to hingeably attach the slide plate 180 to the retention paddle 110. Here, a first and second hinge pin 151 and 152 are utilized to hingeably connect the protrusions with one another (the first hinge pin 151 is not visible in FIG. 13, see FIG. 14). In this embodiment, the spring 140 mounts on the second hinge pin 152; this may vary in other embodiments.

Figure 14:
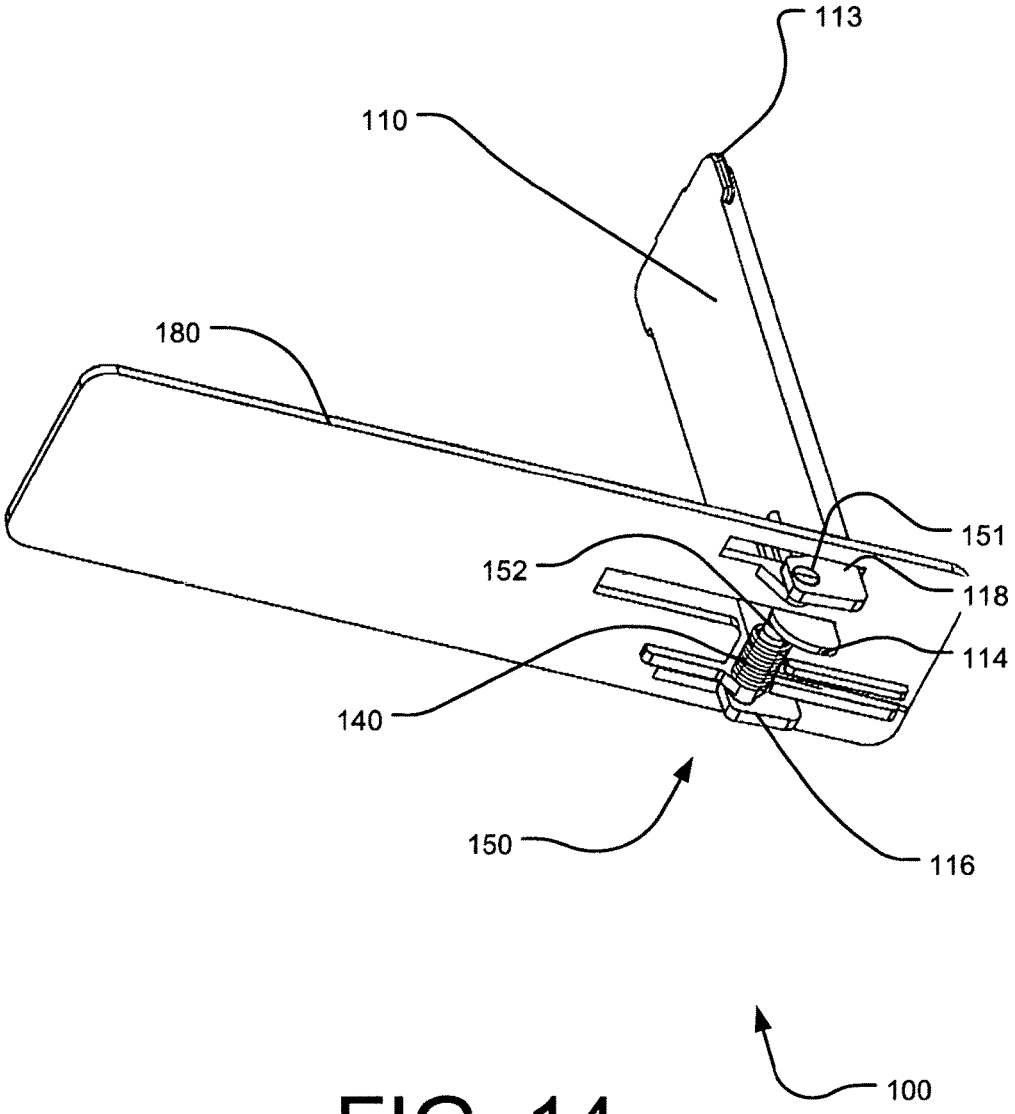
FIG. 14 illustrates a close-up perspective view of the underside of an exemplary embodiment of the slide plate of a pop-up retainer highlighting the hinge components.

FIG. 14 illustrates a close-up perspective view of the underside of an exemplary embodiment of the slide plate 180 of a pop-up retainer 100 highlighting the hinge components 150. In particular, the first hinge pin 151 is visible in this illustration.

While particular embodiments of the invention have been described and disclosed in the present application, it should be understood that any number of permutations, modifications, or embodiments may be made without departing from the spirit and scope of this invention. Accordingly, it is not the intention of this application to limit this invention in any way except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above "Detailed Description" section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise embodiment or form disclosed herein or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

In light of the above "Detailed Description," the Inventor may make changes to the invention. While the detailed description outlines possible embodiments of the invention and discloses the best mode contemplated, no matter how detailed the above appears in text, the invention may be practiced in a myriad of ways. Thus, implementation details may vary considerably while still being encompassed by the spirit of the invention as disclosed by the inventor. As discussed herein, specific terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

The above specification, examples and data provide a description of the structure and use of exemplary implementations of the described articles of manufacture and methods. It is important to note that many implementations can be made without departing from the spirit and scope of the invention.

What is claimed is:

1. A clamp-on paper towel holder comprising:

a back plate extending longitudinally between a first holder arm attached to the back plate at a first holder arm proximal end and a second holder arm attached to the black plate at a second holder arm proximal end;

the first holder arm extending from the back plate and having a first core grip attached at a first holder arm distal end;

the second holder arm extending from the back plate and having a second core grip attached at a second holder arm distal end;

the back plate being generally rigid and supporting the first and second holder arms such that the first core grip and second core grip are alignable along a straight line;

the first holder arm releasably mounting a first end of a roll of paper towels on the first core grip and the second holder arm releasably mounting a second end of the roll of paper towels on the second core grip;

a clamp mounted on the back plate at a mounting attachment point;

a clamp extension on the back plate and in proximity to the mounting attachment point;

the clamp having a clamp handle and a clamp jaw and wherein the clamp handle is pressed towards the clamp extension in order to open the clamp jaw;

wherein the clamp jaw adapted to clamp onto a mounting object in order to suspend the holder therefrom and allow paper towels to be dispensed;

a pop-up retainer stored below a top surface of a front plate when in a stored position; and wherein the pop-up retainer comprises a retention paddle that pops-up above the top surface of the front plate when in a deployed position such that the retention paddle contacts the roll of paper towels in order to retain a plurality of paper towels on the roll of paper towels until a user actively deploys one of the paper towels.

2. The clamp-on paper towel holder of claim 1, further comprising:

a first hinge point and a second hinge point, the hinge points extending from the back plate; and the clamp handle attached to the clamp jaw at a hinge location, the hinge location arranged between the first hinge point and the second hinge point and the clamp hinging therebetween on a clamp pin.

3. The clamp-on paper towel holder of claim 2, further comprising:

a plurality of non-slip grip strips arranged between the clamp jaw and the back plate and assisting the clamp in suspending the holder.

4. The clamp-on paper towel holder of claim 2, further comprising:

the first holder arm is hingeably attached to the back plate via a first hingeable mount; and wherein the first hingeable mount allows the first holder arm to swing inwards towards the back plate.

5. The clamp-on paper towel holder of claim 4, further comprising:

the second holder arm is hingeably attached to the back plate via a second hingeable mount; and wherein the second hingeable mount allows the second holder arm to swing inwards towards the back plate.

6. The clamp-on paper towel holder of claim 1, further comprising:

a plurality of non-slip grip strips arranged between the clamp jaw and the back plate and assisting the clamp in suspending the holder.

7. The clamp-on paper towel holder of claim 6, further comprising:

the first holder arm is hingeably attached to the back plate via a first hingeable mount; and wherein the first hingeable mount allows the first holder arm to swing inwards towards the back plate.

8. The clamp-on paper towel holder of claim 7, further comprising:

the second holder arm is hingeably attached to the back plate via a second hingeable mount; and wherein the second hingeable mount allows the second holder arm to swing inwards towards the back plate.

9. The clamp-on paper towel holder of claim 1, further comprising:

the first holder arm is hingeably attached to the back plate via a first hingeable mount; and wherein the first hingeable mount allows the first holder arm to swing inwards towards the back plate.

10. The clamp-on paper towel holder of claim 9, further comprising:

the second holder arm is hingeably attached to the back plate via a second hingeable mount; and wherein the second hingeable mount allows the second holder arm to swing inwards towards the back plate.

11. A clamp-on paper towel holder comprising:

a back plate extending longitudinally between a first holder arm attached to the back plate at a first holder arm proximal end and a second holder arm attached to the black plate at a second holder arm proximal end;

the first holder arm extending from the back plate and having a first core grip attached at a first holder arm distal end;

the second holder arm extending from the back plate and having a second core grip attached at a second holder arm distal end;

the back plate being generally rigid and supporting the first and second holder arms such that the first core grip and second core grip are alignable along a straight line;

the first holder arm releasably mounting a first end of a roll of paper towels on the first core grip and the second holder arm releasably mounting a second end of the roll of paper towels on the second core grip;

a plurality of clamps mounted on the back plate at a plurality of mounting attachment points;

a plurality of clamp extensions;

the plurality of clamps each having a clamp handle and an associated clamp jaw and wherein each clamp handle is associated with one of the plurality of clamp extensions and is pressed towards said associated clamp extension in order to open the associated clamp jaw;

wherein each clamp jaw adapted to clamp onto a mounting object in order to suspend the holder therefrom and allow paper towels to be dispensed;

a pop-up retainer stored below a top surface of a front plate when in a stored position; and wherein the pop-up retainer comprises a retention paddle that pops-up above the top surface of the front plate when in a deployed position such that the retention paddle contacts the roll of paper towels in order to retain a plurality of paper towels on the roll of paper towels until a user actively deploys one of the paper towels.

12. The clamp-on paper towel holder of claim 11, further comprising:

a first hinge point and a second hinge point, the hinge points extending from the surface of the back plate housing a clamp pin, the clamp pin extending through the clamp between the clamp jaw portion and the clamp handle and the clamp pin providing a structure on which the clamp hinges.

13. The clamp-on paper towel holder of claim 12, further comprising:

a plurality of non-slip grip strips arranged between the clamp jaw and the back plate and assisting the clamp in suspending the holder.

14. The clamp-on paper towel holder of claim 12, further comprising:

the first holder arm is hingeably attached to the back plate via a first hingeable mount; and wherein the first hingeable mount allows the first holder arm to swing inwards towards the back plate.

15. The clamp-on paper towel holder of claim 14, further comprising:

the second holder arm is hingeably attached to the back plate via a second hingeable mount; and wherein the second hingeable mount allows the second holder arm to swing inwards towards the back plate.

16. The clamp-on paper towel holder of claim 11, further comprising:

a plurality of non-slip grip strips arranged between the clamp jaw and the back plate and assisting the clamp in suspending the holder.

17. The clamp-on paper towel holder of claim 16, further comprising:

the first holder arm is hingeably attached to the back plate via a first hingeable mount;

wherein the first hingeable mount allows the first holder arm to swing inwards towards the back plate;

the second holder arm is hingeably attached to the back plate via a second hingeable mount; and wherein the second hingeable mount allows the second holder arm to swing inwards towards the back plate.

18. The clamp-on paper towel holder of claim 11, further comprising:

the first holder arm is hingeably attached to the back plate via a first hingeable mount; and wherein the first hingeable mount allows the first holder arm to swing inwards towards the back plate.

19. The clamp-on paper towel holder of claim 18, further comprising:

the second holder arm is hingeably attached to the back plate via a second hingeable mount; and wherein the second hingeable mount allows the second holder arm to swing inwards towards the back plate.

20. A clamp-on paper towel holder comprising:

a back plate extending longitudinally between a first holder arm attached to the back plate at a first holder arm proximal end and a second holder arm attached to the black plate at a second holder arm proximal end;

the first holder arm extending from the back plate and having a first core grip attached at a first holder arm distal end;

the second holder arm extending from the back plate and having a second cord grip attached at a second holder arm distal end;

the back plate being generally rigid and supporting the first and second holder arms such that the first core grip and second core grip are alignable along a straight line;

the first holder arm releasably mounting a first end of a roll of paper towels on the first core grip and the second holder arm releasably mounting a second end of the roll of paper towels on the second core grip;

a first clamp mounted on the back plate at a first mounting attachment point;

a first clamp extension on the back plate and in proximity to the first mounting attachment point;

the first clamp having a first clamp handle and a first clamp jaw and wherein the first clamp handle is pressed towards the first clamp extension in order to open the first clamp jaw;

a second clamp mounted on the back plate at a second mounting attachment point;

a second clamp extension on the back plate and in proximity to the second mounting attachment point;

the second clamp having a second clamp handle and a second clamp jaw and wherein the second clamp handle is pressed towards the second clamp extension in order to open the second clamp jaw;

wherein the first and second clamp jaws adapted to clamp onto a mounting object in order to suspend the holder therefrom and allow paper towels to be dispensed;

a pop-up retainer stored below a top surface of a front plate when in a stored position; and wherein the pop-up retainer comprises a retention paddle that pops-up above the top surface of the front plate when in a deployed position such that the retention paddle contacts the roll of paper towels in order to retain a plurality of paper towels on the roll of paper towels until a user actively deploys one of the paper towels.

* * * * *